US008442261B2

(12) United States Patent
Kamimura et al.

(10) Patent No.: US 8,442,261 B2
(45) Date of Patent: May 14, 2013

(54) DIAPHRAGM INCLUDING A FIRST VIBRATING PART OF A DOME SHAPE OR FLAT SHAPE AND A SECOND VIBRATING PART OF AN ANNULAR SHAPE AND A LOUDSPEAKER USING THE DIAPHRAGM

(75) Inventors: Tomohiko Kamimura, Yao (JP); Hideo Yuasa, Qingdao (CN); Masahito Ikeda, Qingdao (CN)

(73) Assignee: Hosiden Corporation, Yao-shi (JP)

( * ) Notice: Subject to any disclaimer, the term of this patent is extended or adjusted under 35 U.S.C. 154(b) by 496 days.

(21) Appl. No.: 12/464,264

(22) Filed: May 12, 2009

(65) Prior Publication Data

US 2009/0304225 A1 Dec. 10, 2009

(30) Foreign Application Priority Data

Jun. 4, 2008 (JP) ..... 2008-146973

(51) Int. Cl.
*H04R 7/06* (2006.01)

(52) U.S. Cl.
USPC ..... 381/423; 381/426; 181/165; 181/167

(58) Field of Classification Search ..... 181/164, 181/165, 167, 168, 169, 170; 381/423, 426, 381/427, 428
See application file for complete search history.

(56) References Cited

U.S. PATENT DOCUMENTS

| | | | | |
|---|---|---|---|---|
| 4,140,203 | A | 2/1979 | Niguchi et al. | 181/167 |
| 4,582,163 | A | 4/1986 | Catthoor | 181/169 |
| 5,744,761 | A | 4/1998 | Ogura et al. | 181/167 |
| 6,445,803 | B1 * | 9/2002 | Boon et al. | 381/184 |
| 2004/0112672 | A1 | 6/2004 | Ono et al. | 181/169 |
| 2006/0249327 | A1 * | 11/2006 | Sato et al. | 181/167 |
| 2007/0023229 | A1 * | 2/2007 | Yang | 181/174 |
| 2008/0053745 | A1 * | 3/2008 | Tada et al. | 181/165 |

FOREIGN PATENT DOCUMENTS

| | | | |
|---|---|---|---|
| JP | S57-102296 | U | 12/1955 |
| JP | 52-93317 | | 8/1977 |
| JP | 3643855 | B2 | 2/2005 |
| JP | 2005-110092 | A1 | 4/2005 |
| JP | 2006-220613 | A | 8/2006 |
| JP | 2007-258864 | A | 10/2007 |
| JP | 2008-085985 | | 4/2008 |

OTHER PUBLICATIONS

Extended European Search Report issued on counterpart application No. 09251473.6 dated Apr. 26, 2011 (9 pages).
Notification of Reasons for Refusal mailed on Feb. 1, 2011 for the counterpart Japanese application No. 2008-146973 with English translation.

* cited by examiner

*Primary Examiner* — Jeremy Luks
(74) *Attorney, Agent, or Firm* — Kratz, Quintos & Hanson, LLP

(57) ABSTRACT

The present invention provides a dome-shaped diaphragm fabricated based on a film base of polyethylene terephthalate resin film. The diaphragm includes a first vibrating part of a dome shape or a flat shape, and a second vibrating part of an annular shape. The second vibrating part includes a peripheral portion of the film base provided around a central portion of the film base. The first vibrating part includes the central portion of the film base, a thermosensitive adhesive resin film, provided on the central portion, and a fiber sheet made of a woven fabric using carbon fiber or an embossed nonwoven fabric. The fiber sheet is layered over the central portion with the thermosensitive adhesive resin film interposed therebetween.

10 Claims, 7 Drawing Sheets

(a)

(b)

DIAPHRAGM INCLUDING A FIRST VIBRATING PART OF A DOME SHAPE OR FLAT SHAPE AND A SECOND VIBRATING PART OF AN ANNULAR SHAPE AND A LOUDSPEAKER USING THE DIAPHRAGM

The present application claims priority under 35 U.S.C. §119 of Japanese Patent Application No. 2008-146973 filed on Jun. 4, 2008, the disclosure of which is expressly incorporated by reference herein in its entity.

TECHNICAL FIELD

The present invention relates to dome-shaped diaphragms to be used for small-sized loudspeakers and microphones, and also relates to loudspeakers using such dome-shaped diaphragms.

BACKGROUND ART

As various electric devices, notably cellular phones and the like, have been reduced in size and thickness, loudspeakers built into such electric devices are also desired to be smaller and thinner. In such a situation, a loudspeaker having a dome-shaped diaphragm as shown in FIG. 7 is known as one that realizes not only reduction in size and thickness but also excellent sound quality.

The loudspeaker in the figure includes a frame yoke 100 made of a magnetic material and centrally provided with a bottomed cylinder 110, a columnar magnet 200 that is fixedly attached to the bottom of the bottomed cylinder 110, and a disk shaped pole piece 300 that is fixedly attached to the upper surface of the magnet 200. The bottomed cylinder 110, the magnet 200, and the pole piece 300 constitute a magnetic circuit of the loudspeaker. An annular magnetic gap G is formed in a space between the inner circumferential surface of the bottomed cylinder 110 and the outer circumferential surface of the pole piece 300.

The conventional loudspeaker has a circular dome-shaped diaphragm 500 made of polyethylene terephthalate (PET) resin and fixedly attached to an outer edge portion of the frame yoke 100. In order to increase rigidity, this diaphragm has a double-layered structure excluding its outer circumferential edge. A cylindrical voice coil 400 is attached to the lower surface of the dome-shaped diaphragm 200. In this state, the voice coil 400 is positioned within the magnetic gap G. The dome-shaped diaphragm 500 and the voice coil 400 constitute a vibration system of the loudspeaker.

In the loudspeaker having the above-described structure, when amplified audio signals are inputted to the voice coil 400 via a terminal not shown, electromagnetic actions are produced between the voice coil 400 and the magnet 200 to cause vibrations of the dome-shaped diaphragm 500 and the voice coil 400, and thus sounds according to the audio signals are reproduced.

General requirements for a diaphragm of a loudspeaker reproducing high-quality sound are lightweight, high rigidity, and a moderate level of internal loss. To meet these requirements, Japanese Patent No. 3643855 discloses a diaphragm of a double-layered structure, Japanese Unexamined Patent Publication Nos. 52-93317 and 2005-110092 each disclose a diaphragm in which a thin film is formed over a film base.

SUMMARY OF INVENTION

Technical Problem

Unfortunately, to further improve a frequency response of a loudspeaker, a centrally-provided domed portion of a diaphragm requires improved rigidity as a physical characteristic for reproducing higher frequency components in high quality, while an edge portion that surrounds the domed portion requires improved flexibility as a physical Characteristic for reproducing lower frequency components in high quality.

The physical characteristics required for the domed portion and the edge portion are thus conflicting to each other in a sense. At the same time, challenges should be made to meet demands for reduced size, weight, and thickness of a loudspeaker. In reality, it is an intractable technical challenge to develop a diaphragm that satisfies all of the above physical characteristics requirements.

The present invention is contrived in view of the above circumstances. An object of the present invention is to provide a dome-shaped diaphragm with further improved frequency response in comparison with the conventional ones, and to provide a loudspeaker using such a dome-shaped diaphragm.

Solution to Problem

The present invention provides a dome-shaped diaphragm fabricated based on a film base of polyethylene terephthalate resin film. The diaphragm includes a first vibrating part of a dome shape or a flat shape, and a second vibrating part of an annular shape. The second vibrating part includes a peripheral portion of the film base provided around a central portion of the film base. The first vibrating part includes the central portion of the film base, a thermosensitive adhesive resin film, provided on the central portion, and a fiber sheet made of a woven fabric using carbon fiber or an embossed nonwoven fabric. The fiber sheet is layered over the central portion with the thermosensitive adhesive resin film interposed therebetween.

According to the present invention, the thermosensitive adhesive resin film melts due to heat during affixation, thereby affixing between the base and the fiber sheet. Specifically, the thermosensitive adhesive resin film not only affixes the fiber sheet to the base, but also helps to improve rigidity of the first vibrating part. Therefore, the invention can improve frequency response in a higher frequency range in comparison to the conventional art. Further, the diaphragm of the invention is based on an existing base, onto the central portion of which the fiber sheet is simply affixed using the thermosensitive adhesive resin film. Therefore, the invention can be implemented without making extensive design changes to the conventional art and is advantageous in terms of manufacturing costs.

In the dome-shaped diaphragm, the thermosensitive adhesive resin film may melt due to heat during affixation and come into the fiber sheet, thereby hardening the fiber sheet.

In this aspect of the invention, some component of the thermosensitive adhesive resin film comes into gaps between fibers or the weave pattern of the fiber sheet, and thereby hardens the fiber sheet entirely or partly. Accordingly, the invention further improves rigidity of the first vibrating part, resulting in further improvement of the frequency response in the higher frequency range.

In the dome-shaped diaphragm, the first vibrating part may further include a top film. The first vibrating part may be configured such that the central portion of the film base, the thermosensitive adhesive resin film, the fiber sheet, and the top film are sequentially layered. The top film may be an aluminum foil.

In this aspect of the invention, the fiber sheet is sandwiched and protected between the base and the top film, and a melted portion of the thermosensitive adhesive resin film will not be exposed. Accordingly, the affixing work can be easily carried out.

The second vibrating part may further include an additional film base affixed onto the peripheral portion of the film base using an adhesive material.

In this case, although the second vibrating part has a double-layer structure, it is still more flexible than the first vibrating part because the adhesive material such as adhesive layers of a double-sided adhesive tape is used for affixation. Therefore, this aspect of the invention is advantageous over the conventional art in terms of the frequency response in a lower frequency range in addition to the higher frequency range.

A loudspeaker according to the present invention includes the dome-shaped diaphragm as described above.

The loudspeaker of the invention includes the dome-shaped diaphragm with improved frequency response in comparison with the conventional art without extensive design changes. Therefore, the loudspeaker of the invention is advantageous with improved quality and reduced costs, as well as reduced size, weight and thickness.

BRIEF DESCRIPTION OF DRAWINGS

FIGS. 3A and 3B are schematic diagrams illustrating structures of a fiber sheet of the dome-shaped diaphragm, in which FIG. 3A shows a case of a woven fabric using tetra-axial carbon fiber, and FIG. 3B shows a case of an embossed nonwoven fabric;

DESCRIPTION OF EMBODIMENTS

Figure 1:
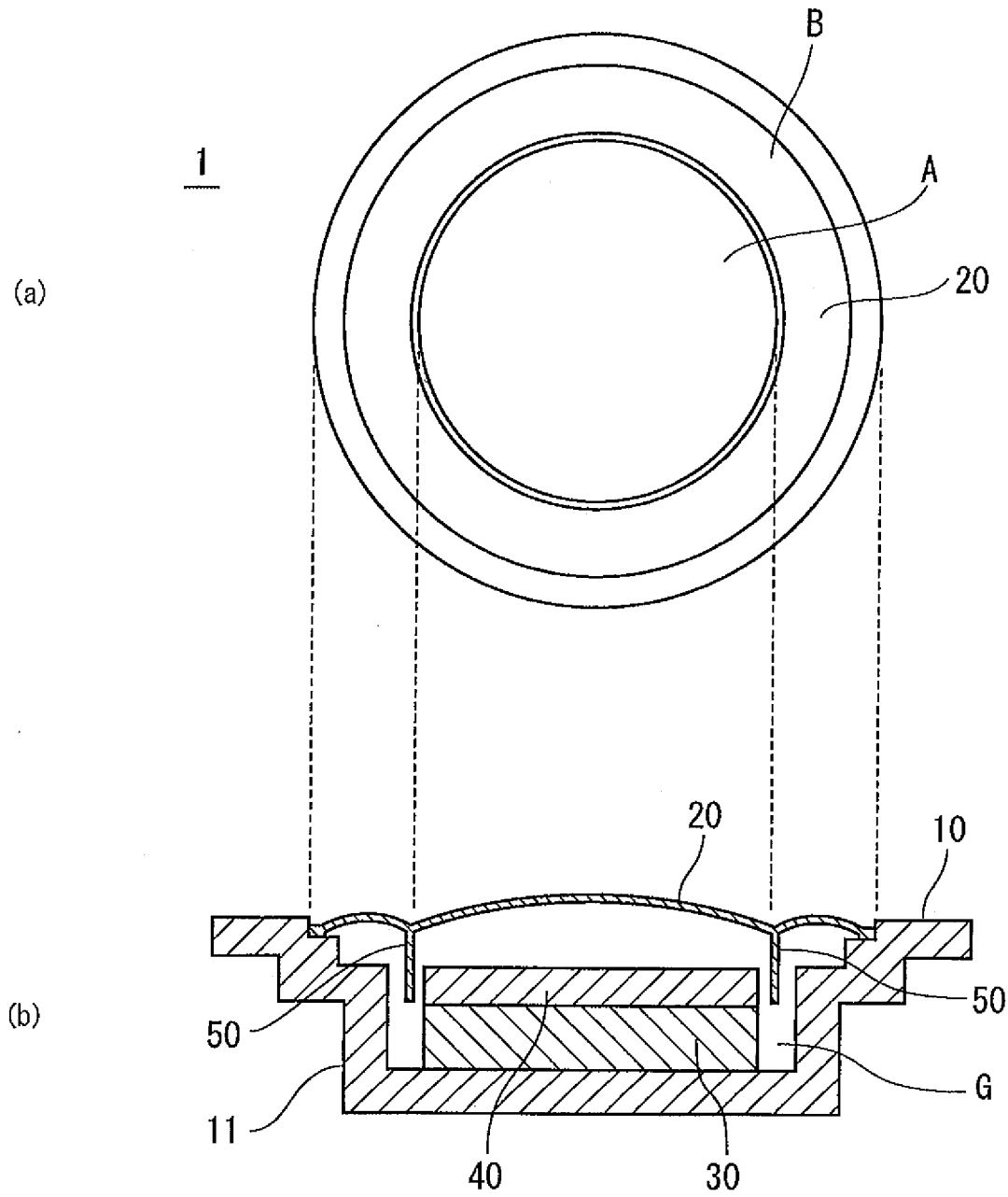
FIG. 1 illustrates a loudspeaker according to an embodiment of the present invention, wherein FIG. 1(*a*) is a partial plan view and FIG. 1(*b*) is a longitudinal cross-sectional view.

The following describes an embodiment according to the present invention with reference to the drawings. A loudspeaker 1 is generally shown in FIG. 1, wherein FIG. 1(*a*) is a partial plan view and FIG. 1(*b*) is a longitudinal cross-sectional view. The figure shows that the loudspeaker 1 includes a frame yoke 10, a dome-shaped diaphragm 20, a magnet 30, a pole piece 40, and a voice coil 50.

The frame yoke 10 is made of a magnetic material. It has a centrally located cylinder 11 with a bottom, on which the columnar magnet 30 is secured. The magnet 30 is fixedly topped with the pole piece 40 of a disk shape. The space between the inner circumferential surface of the bottomed cylinder 11 and the outer circumferential surface of the pole piece 40 serves as an annular magnetic gap G.

Further, the outer edge portion of the frame yoke 10 is provided with the fixedly attached dome-shaped diaphragm 20. In this fixedly attached state, the cylindrical voice coil 50 that is attached to the lower surface of the dome-shaped diaphragm 20 should be positioned within the magnetic gap G. The bottomed cylinder 11, the magnet 30, and the pole piece 40 constitute a magnetic circuit of the loudspeaker. On the other hand, the dome-shaped diaphragm 20 and the voice coil 50 constitute a vibration system of the loudspeaker.

Figure 2:
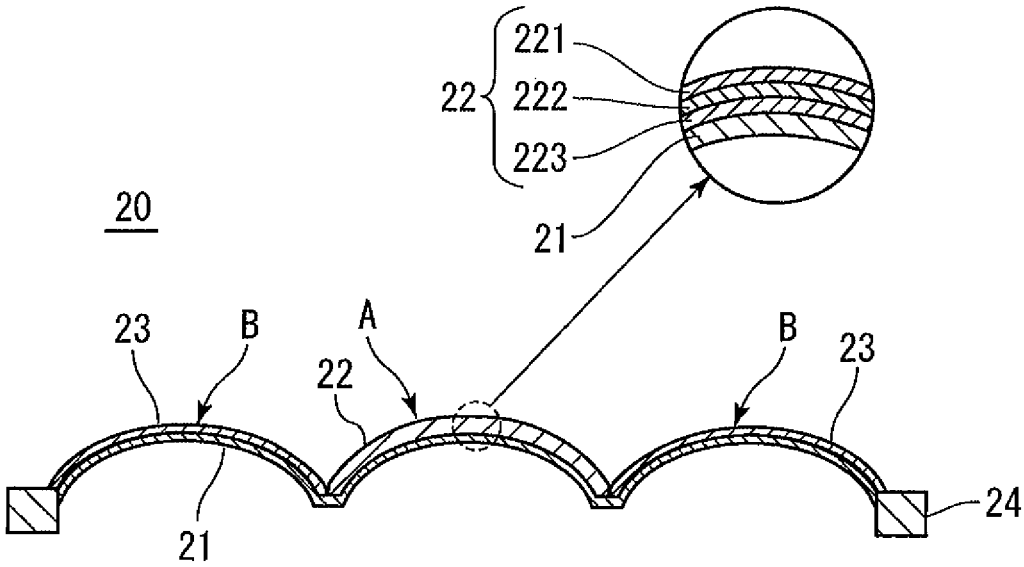
FIG. 2 is a schematic cross-sectional view of a dome-shaped diaphragm of the loudspeaker.

FIG. 2 is a schematic cross-sectional view illustrating the dome-shaped diaphragm 20. The dome-shaped diaphragm 20, based on a film base 21 made of polyethylene terephthalate resin film (PET), consists of a dome-shaped first vibrating part A and an annular second vibrating part B. The first vibrating part A consists of a central portion of the film base 21 and a sheet group 22. The second vibrating part B consists of the remaining outer peripheral portion of the film base 21 and an additional film base 23. One of the most distinctive features of the diaphragm 20 is that the first vibrating part A is structured such that a fiber sheet 222 of the sheet group 22 is layered over the central portion of the film base 21 with a thermosensitive adhesive resin film 223 of the sheet group 22 interposed therebetween. This layered structure will be described more in detail below. FIG. 2 also shows an annular frame 24 provided along the outer edge of the dome-shaped diaphragm 20.

The dome-shaped sheet group 22 is affixed onto the surface of the first vibrating part A of the film base 21, i.e. the central portion of the film base 21. The sheet group 22 has a three-layer structure, in which the thermosensitive adhesive resin film 223, the fiber sheet 222, and a top sheet 221 are laminated, in this order, on top of the central portion of the film base 21. The sheet group 22 may be fabricated by cutting raw sheets for the top sheet 221, the fiber sheet 222, and the thermosensitive adhesive resin film 223 into the shape of the first vibrating part A and laminating the cut sheets.

Figure 3:
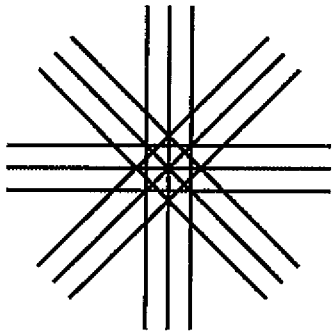
Figure 3:
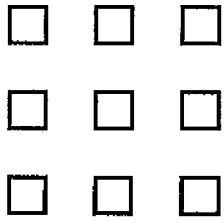

The fiber sheet 222 of the present embodiment is a woven fabric using tetra-axial carbon fiber. However, the fiber sheet 222 is not limited to one using tetra-axial carbon fiber, but may be a woven fabric using a more common kind of carbon fiber or may be an embossed nonwoven fabric. FIG. 3 schematically illustrates inner structures of the fiber sheet 222, wherein FIG. 3A illustrates a case of a woven fabric using tetra-axial carbon fiber, FIG. 3B illustrates a case of an embossed nonwoven fabric.

The thermosensitive adhesive resin film 223 is used to apply the sheet group 22 to a surface of the central portion of the film base 21. Another and important use of the resin film 223 is that its surface layer melts due to heat during heating and then cools and hardens to form a hardened layer, thereby serving the function of hardening the entire or a large part of the first vibrating part A.

In the present embodiment, the surface layer of the thermosensitive adhesive resin film 223 melts due to heat during bonding and comes into the fiber sheet 222 (into gaps between fibers or the weave pattern of the sheet or the like), thereby hardens the entire fiber sheet 222. Depending on a required degree of rigidity and the like for the first vibrating part A, appropriate selections should be made of the type and the thickness of the thermosensitive adhesive resin film 223, and of the type, the widths and the pitches, etc. of fibers to form the fiber sheet 222.

The top sheet 221 may be an aluminum foil. Its functions includes to serve as a protecting layer for the fiber sheet 222 and to prevent exposure of the melted part of the thermosensitive adhesive resin film 223. As long as these functions can be fulfilled, the top sheet may be made of any material.

As described above, the first vibrating part A is configured such that the film base 21, the thermosensitive adhesive resin film 223, the fiber sheet 222, and the top sheet 221 are layered in the stated order. As such, the first vibrating part A advantageously demonstrates high rigidity in spite of its reduced weight.

As shown in FIG. 2, the additional film base 23 is affixed using an adhesive material on a surface of the second vibrating part B of the film base 21 (i.e. the peripheral portion of the film base 21). This additional film base 23 is made of the same material and thickness as those of the base 21. The adhesive material may simply bond between the film base 21 and the additional film base 23, without hardening as the thermosensitive adhesive resin film 223 does. For example, adhesive layers of a double-sided adhesive tape may be used as the adhesive material.

As described above, the second vibrating part B is not only thinner than the first vibrating part A, but also structured without stacking the fiber sheet 222 and the top sheet 221. Accordingly, the second vibrating part B is more flexible in comparison with the first vibrating part A.

In the present embodiment, the thickness of each component material is set as follows: The film base 21 and the additional film base 23 are each 4 to 50 μm in thickness, the fiber sheet 222 is 100 to 150 μm in thickness, the top sheet 221 is 5 to 35 μm in thickness, and the thermosensitive adhesive resin film 223 is 5 to 50 μm in thickness. The above thicknesses may be each changed according to an output of the loudspeaker, frequencies to be used, etc.

The loudspeaker 1 configured as described above reproduce sounds in the following manner. When amplified audio signals are inputted to the voice coil 50 via a terminal not shown, electromagnetic actions are produced between the voice coil 50 and the magnet 30 to cause vibrations of the dome-shaped diaphragm 20 and the voice coil 50. The loudspeaker 1 thus reproduce sounds according to the audio signals.

Figure 4:
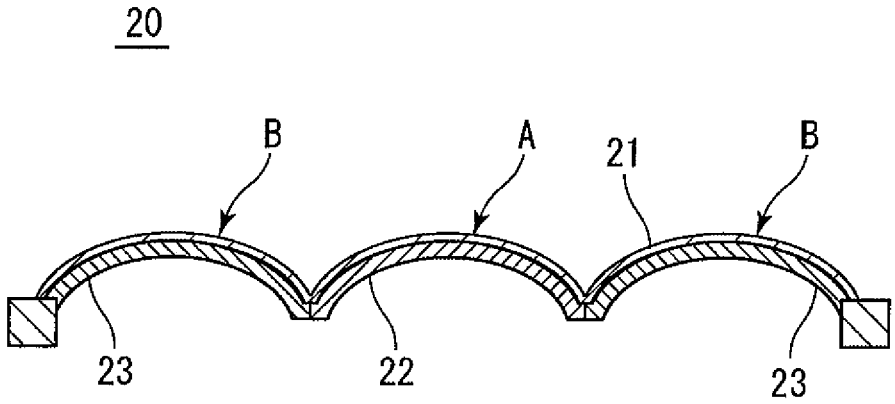
FIG. 4 is a schematic cross-sectional view illustrating a modified example of the dome-shaped diaphragm.

The dome-shaped diaphragm 20 used in the loudspeaker 1 has many advantageous features. First, the first vibrating part A of the diaphragm 20 is reduced in weight and improved in rigidity, enjoying an improved frequency response in a higher frequency range in comparison to conventional diaphragms. Second, as the edge portion diaphragm 20 also has a soft edge, i.e. the second vibrating part B is improved in flexibility, the frequency response in a lower frequency range is also improved in comparison to conventional diaphragms. These advantages also hold good for a modified case as shown in FIG. 4 where the sheet group 22 and the additional film base 23 are applied to back surfaces of the central and peripheral portions, respectively, of the film base 21.

A further advantageous feature is that the diaphragm 20 can be manufactured without extensive design changes because it is based on a existing film base, film base 21, onto which the sheet group 22 and the additional film base 23 are be simply affixed. In addition, the affixation of the sheet group 22 to the film base 21 can be made in a quite simple manner and can be realized only with a slight change in the design. Thus, the diaphragm 20 has an improved frequency response with a reduced cost, significantly contributing to improving the quality and reducing manufacturing costs of the loudspeaker incorporating the stated diaphragm.

Figure 5:
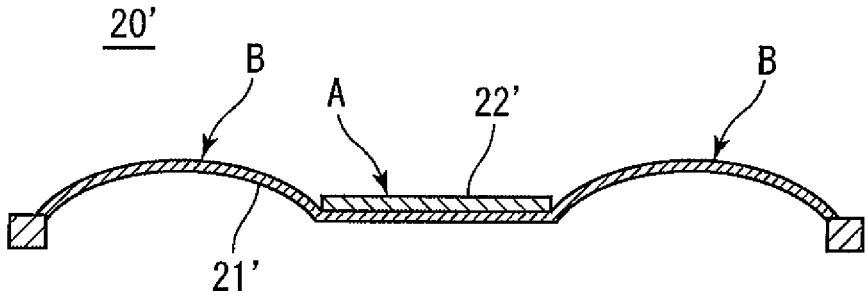
FIG. 5 is a schematic cross-sectional view illustrating another modified example of the dome-shaped diaphragm.
Figure 6:
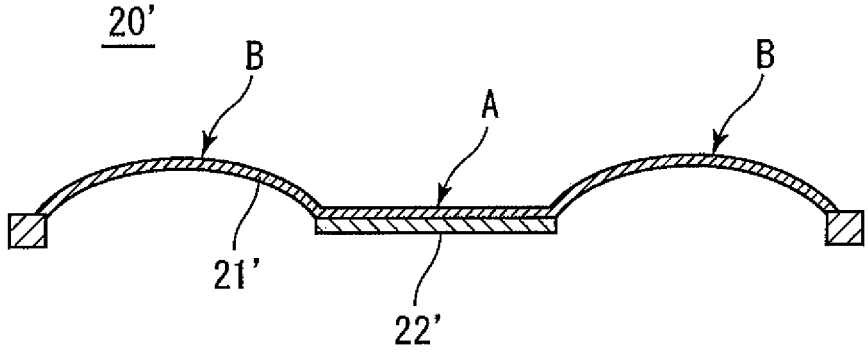
FIG. 6 is a schematic cross-sectional view illustrating another modified example of the dome-shaped diaphragm.
Figure 7:
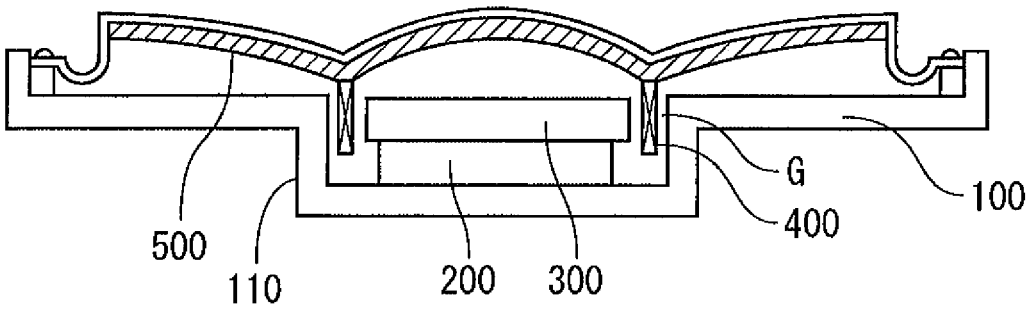
FIG. 7 Prior Art
FIG. 7 is a longitudinal cross-sectional view illustrating a conventional loudspeaker.

Next, modified examples of the dome-shaped diaphragm 20 is described with reference to FIGS. 5 and 6. FIG. 5 is a schematic cross-sectional view of a dome-shaped diaphragm 20'. The dome-shaped diaphragm 20' shown in FIG. 5 is largely different from the dome-shaped diaphragm 20 shown in FIG. 2 in that the first vibrating part A (the central portion) of a film base 21' is in a flat shape. Accordingly, a sheet group 22' is also in a flat shape. Except these differences, the dome-shaped diaphragm 20' has the same configuration as the dome-shaped diaphragm 20. As shown in FIG. 6, the sheet group 22' may be affixed not to the front surface but to the back surface of the film base 21', as in the modified diaphragm 20 as shown in FIG. 4.

The dome-shaped diaphragm according to the present invention may have first and second vibrating parts of different general shapes from those of the above embodiment, as long as the first vibrating part is structured such that a fiber sheet is layered over the central portion of a base film with a thermosensitive adhesive resin film interposed therebetween. Further, the film base and the additional film base may be different in material and thickness. The additional film may be affixed not entirely but partially onto the peripheral portion of the film base.

The loudspeaker according to the present invention is not limited to the embodiment described above. It may have any basic structure do not matter as long as it incorporates the surface of the dome-shaped diaphragm recited in the claims.

REFERENCE SIGNS LIST

1 Loudspeaker
- 10 Frame yoke
- 20 Dome-shaped diaphragm
  - A First vibrating part
  - B Second vibrating part
  - 21 Film base
  - 22 Sheet group
    - 221 Top sheet
    - 222 Fiber sheet
    - 223 Thermosensitive adhesive resin film
  - 23 Additional film base
- 30 Magnet
- 40 Pole piece
- 50 Voice coil

CITATION LIST

Patent Literature 1: Japanese Patent No. 3643855

Patent Literature 2: Japanese Unexamined Patent Publication No. 52-93317

Patent Literature 3: Japanese Unexamined Patent Publication No. 2005-110092

The invention claimed is:

1. A diaphragm based on a film base of polyethylene terephthalate resin film, the diaphragm comprising:

a first vibrating part of a dome shape, the first vibrating part including:

a central portion of the film base, being of a dome shape and made of polyethylene terephthalate resin, a thermosensitive adhesive resin film, provided only on the central portion, and a fiber sheet, being of a dome shape and made of a woven fabric using carbon fiber or an embossed nonwoven fabric, the fiber sheet being provided only on thermosensitive adhesive resin film; and a second vibrating part of an annular shape, being made of polyethylene terephthalate resin and including a peripheral portion of the film base provided around the central portion of the film base, wherein a boundary between the central portion and the peripheral portion of the film base forms a valley.

2. The diaphragm according to claim 1, wherein the thermosensitive adhesive resin film is adapted to melt due to heat during affixation and come into the fiber sheet, thereby hardening the fiber sheet.

3. The diaphragm according to claim 1, the first vibrating part further including a top film, wherein the first vibrating part is configured such that the central portion of the film base, the thermosensitive adhesive resin film, the fiber sheet, and the top film are sequentially layered.

4. The diaphragm according to claim 1, wherein the second vibrating part further includes an additional film base affixed onto the peripheral portion of the film base using an adhesive material.

5. The diaphragm according to claim 3, wherein the top film comprises an aluminum foil.

6. A loudspeaker, comprising the diaphragm according to claim 1.

7. A loudspeaker, comprising the diaphragm according to claim 2.

8. A loudspeaker, comprising the diaphragm according to claim 3.

9. A loudspeaker, comprising the diaphragm according to claim 4.

10. A loudspeaker, comprising the diaphragm according to claim 5.

* * * * *